United States Patent [19]

Ashby

[11] Patent Number: 5,024,374

[45] Date of Patent: Jun. 18, 1991

[54] FLYLESS MAILER HAVING TOP SHEET WITH CUTOUT

[75] Inventor: Robert E. Ashby, Quakertown, Pa.

[73] Assignee: Moore Business Forms, Inc., Del.

[21] Appl. No.: 479,704

[22] Filed: Feb. 15, 1990

[51] Int. Cl.[5] ..... B65D 27/06; B65D 27/10

[52] U.S. Cl. ..... 229/71; 229/73; 462/7

[58] Field of Search ..... 229/69, 71, 73; 282/11.5 R, 11.5 A

[56] References Cited

U.S. PATENT DOCUMENTS 4,172,605 10/1979 Welsch et al. ..... 229/69 X
4,625,909 12/1986 Ferrando ..... 282/11.5 A X
4,744,508 5/1988 Fowler et al. ..... 229/69 X

FOREIGN PATENT DOCUMENTS 102792 3/1984 European Pat. Off. ..... 229/71
2807712 8/1978 Fed. Rep. of Germany .
2209332 8/1974 France .

*Primary Examiner*—Stephen P. Garbe
*Assistant Examiner*—Jes F. Pascua
*Attorney, Agent, or Firm*—Nixon & Vanderhye

[57] ABSTRACT

A mailer type business form includes a top ply with a cutout having an area and position comparable to an address area on a piece of mail. A second insert ply underlies the top ply including at the cutout. The insert ply has a localized coating of self-imaging material formed directly beneath the cutout and only in the area of the cutout. The cutout is preferably completely open, free of any material in it or covering it. However under some circumstances a patch of transparent material may cover the cutout. Other plies may also be included in the mailer including a return envelope, with a bottom ply cooperating with a top ply to define an out-going envelope.

17 Claims, 2 Drawing Sheets

FLYLESS MAILER HAVING TOP SHEET WITH CUTOUT

BACKGROUND AND SUMMARY OF THE INVENTION

This invention relates to mailer type business forms, also commonly known in the trade as "mailers". Under some circumstances, it is desirable to produce a mailer that does not have a "fly sheet", that is one in which the top sheet of the product offered for sale allows one to view the address information. There have been a number of proposals for providing such a mailer. For example in U.S. Pat. No. 4,729,506 a mailer is provided that has a top sheet with a cutout therein, a transparent patch and a CB coating containing colorless dye disposed beneath the cutout, and a CF coating disposed on an underlying ply in alignment with the transparent patch. There also has been a proposal in U.S. Pat. No. 4,705,298 for the production of a mailer having the web underlying the cutout and a window patch comprises a web of self-imaging material. The self-imaging material is a coating of microcapsules of dye and dye developer. When impacted by an impact printer or the like, the web provides images on itself through the windows covered by the window patches. In U.S. Pat. No. B14,425,386 a mailer is provided which includes a localized self-imaging area on the top surface therein.

The prior art systems as described above each have some practical disadvantages associated therewith. For example in the U.S. Pat. No. 4,729,506, the application of a CB coating to the transparent patch, and the application of the patch so coated to the top web can have practical difficulties associated therewith. The utilization of a window patch web and an underlying web entirely of self-imaging material, as in said U.S. Pat. No. 4,705,298, can provide an unnecessarily thick mailer for some uses. A mailer according to U.S. Pat. No. B14,425,386 can have smearing of the address area as it runs through postal equipment since the postal equipment has the tendency to break the dye capsules, therefore reducing the legibility of the address and making it difficult to machine read.

According to the present invention, a mailer type business form is provided which overcomes the drawbacks associated with the prior art, examples of which are discussed above. The business form according to the present invention has a minimum number of parts and patches, yet provides a legible address area that is not as susceptible to rupture of the dye capsules when passing through postal equipment as some of the prior art systems.

According to the present invention a mailer type business form is provided which comprises the following elements: A top ply having a top surface and a bottom surface, and having means defining a cutout therein, the cutout having an area and position comparable to an address area on a piece of mail. A second, insert, ply underlying the top ply, including the cutout, and having a top surface in contact with the bottom surface of the top ply. A localized coating of self-imaging material formed on the second ply top surface only in the area thereof overlaid by the cutout. And, a third ply cooperating with the top ply to define an outgoing envelope, the second ply overlying the third ply. While a patch of transparent material can be used to cover the cutout by adhesively securing it to the bottom face of the top ply, in the preferred embodiment the cutout is completely open, free of any material therein or covering it.

Also in the preferred embodiment, the cutout has a generally rectangular shape with sides approximately three inches and one inch long, and the localized self-imaging material area has a generally rectangular shape with sides slightly greater in length than the cutout.

A wide variety of configurations and modifications can be provided, and the mailer can have a number of different other components. For example a fourth, insert, ply can have a top face thereof in contact with the bottom face of the second ply, with the second ply having a capsule coat (CB) on the bottom surface thereof, and the fourth ply may have a resin coat (CF) on the top surface thereof aligned with the capsule coat on the coat ply bottom surface. The top ply may have a carbon spot formed on the bottom surface thereof, or where a carbon spot is not provided the top ply may have a pantograph on the top surface thereof and block out print on the bottom surface thereof. A fifth ply is also preferably provided between the third ply and the fourth ply, the fifth ply comprising a return envelope.

It is the primary object of the present invention to provide a simple flyless mail which has maximum legibility of the address. This and other objects of the invention will become clear from an inspection of the detailed description of the invention and from the appended claims.

DETAILED DESCRIPTION OF THE DRAWINGS

Figure 1:
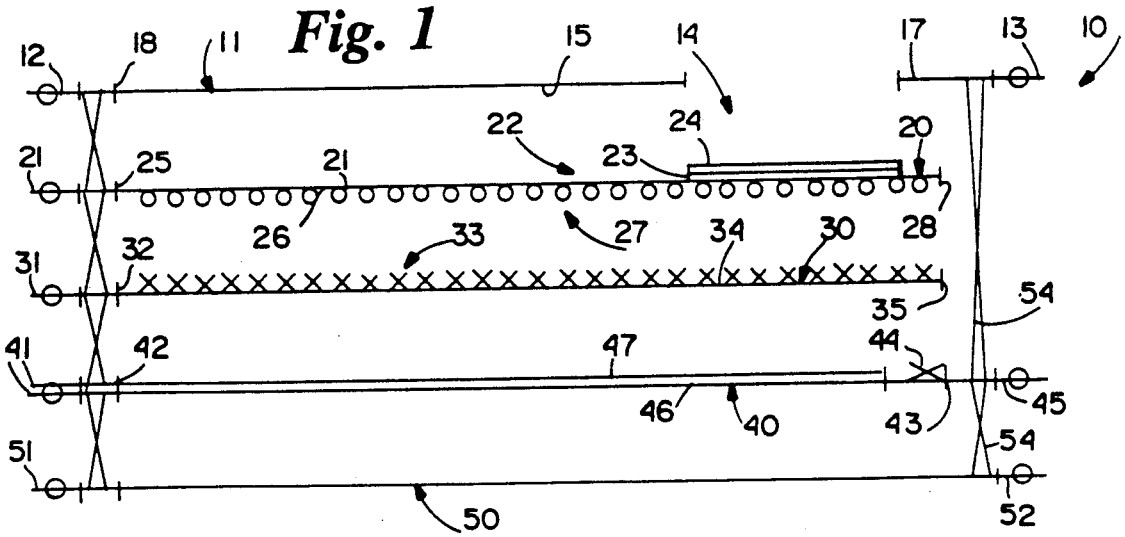
FIG. 1 is a side schematic view of a first embodiment of a mailer type business form according to the present invention.
Figure 2:
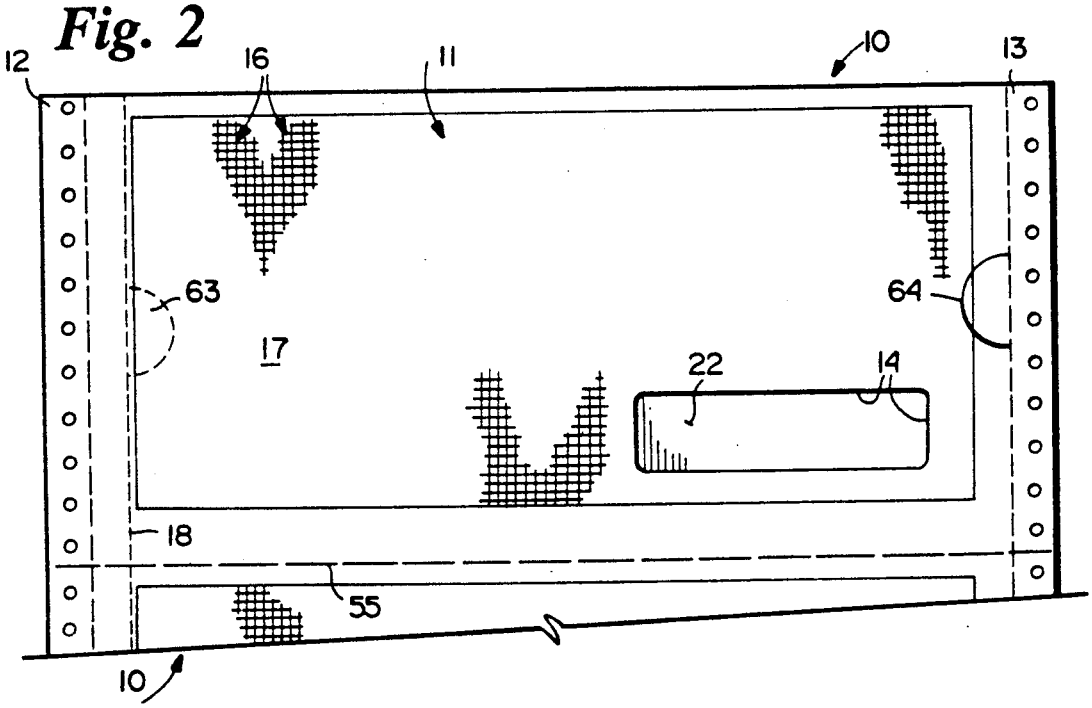
FIG. 2 is a top plan view of the form of FIG. 1 shown connected in continuous manner to a second such form.
Figure 3:
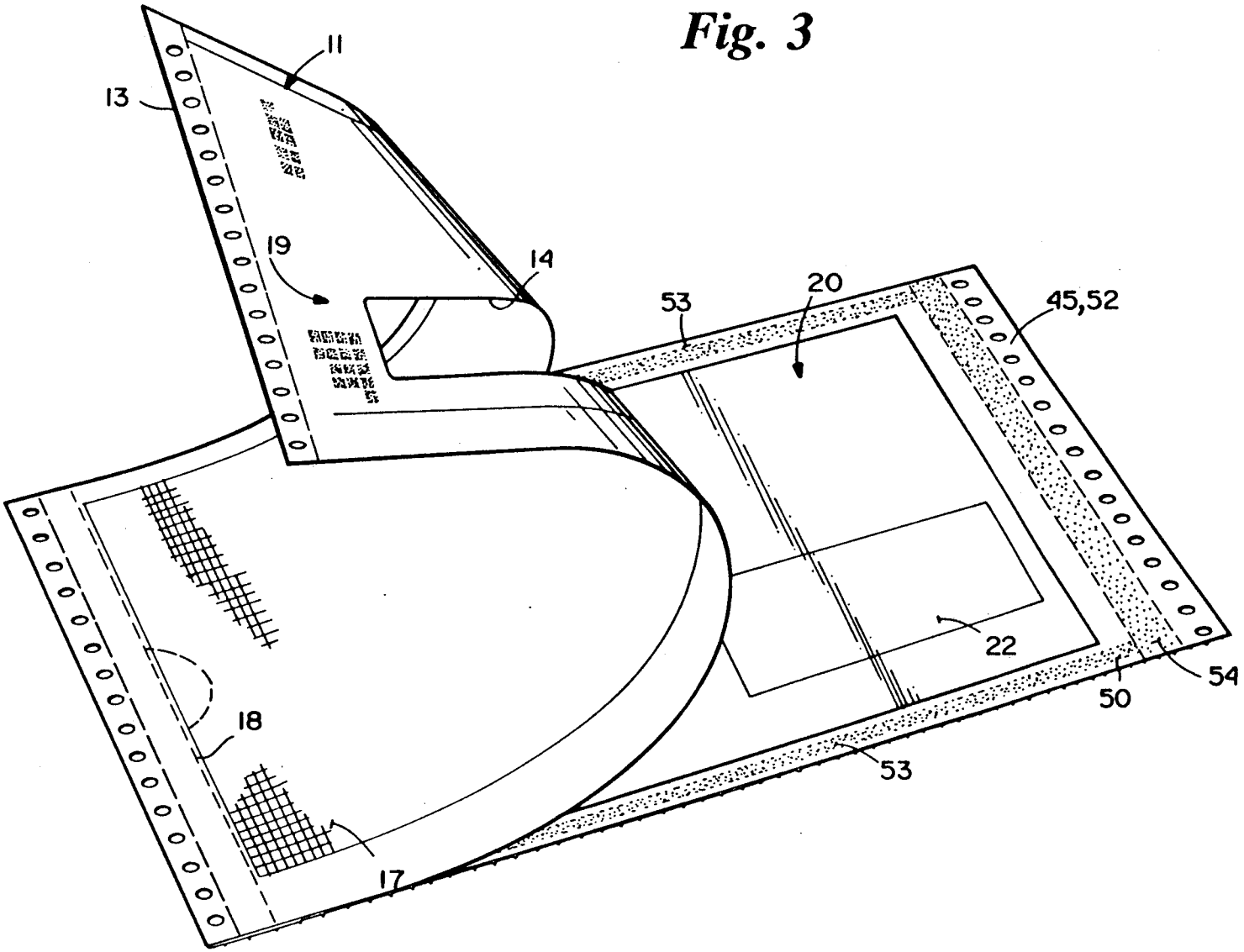
FIG. 3 is a top perspective view of the form of FIGS. 1 and 2 with the top surface partially peeled away for clarity of illustration.

An exemplary mailer type business form according to the invention is shown generally by reference numeral 10 in FIGS. 1 through 3. The business form 10 includes a top ply 11 having marginal tractor drive edges 12 and 13, and means defining a cutout 14 therein. The top ply 11 has a top surface 17, and a bottom surface 15. In the particular embodiment illustrated, a pantograph 16 (see FIG. 2) is provided on the top face 17 to eliminate any possibility of show through of manifold images from underlying plies and as a precautionary measure in case of self-imaging. The bottom surface 15 is also provided with blockout printing 19 (see FIG. 3) so that the underlying information cannot be read through the top ply 11. The cutout 14 has an area and position comparable to an address area on a piece of mail. As illustrated in FIGS. 2 and 3, the cutout 14 preferably has a generally rectangular configuration (with rounded corners in the embodiment illustrated), with a long dimension of about three inches, and a short dimension of about one inch. A perforation 18 adjacent tractor drive edge 12 is also provided.

In the preferred embodiment illustrated in FIG. 1, the cutout 14 is completely open, free of any material therein or covering it.

Underlying the top ply 11 is a second, insert ply 20. The insert ply 20 underlies the top ply 11 at the area of the cutout 14, and has a top surface 21 in contact with the bottom surface 15 of the top ply 11. A localized coating of self-imaging material 22 is formed on the second ply top surface 21 only in the area thereof overlaid by the cutout 14. Preferably the self-imaging material is formed of two layers 23, 24, although it may be formed as a one pass system (such as shown on the top sheet in Chang U.S. Pat. No. 4,425,386). When formed as a two pass system, the sheet 20 preferably is a bond sheet and the self-imaging area 22 is formed of a first layer 23 of MCP-CF with a layer 24 of MCP-CB applied over it. Alternatively, the ply 20 could be MCP-CF or MCP-CFB paper. The self-imaging localized coating 22 is—in the preferred embodiment illustrated in FIGS. 1 through 3—also of generally rectangular configuration corresponding to the configuration of the cutout 14, only having slightly greater dimensions (e.g. a rectangular area with a length of slightly more than three inches, and a width of slightly more than one inch).

The second ply 20 also has a perforation 25 in alignment with the perforation 18 in the top ply 11, and terminates at an end 28. Also, it is preferred that a capsule coating (CB) 27 be provided on the bottom face 26 of the second ply 20. The capsule coat 27 is shown applied over the entire bottom face 20, but it could be localized and non-aligned with the self-imaging material 22 (at a position where it imparts variable data to an underlying ply or plies).

In the preferred embodiment illustrated in FIGS. 1 through 3, a fourth ply 30 is provided beneath the second ply 20. The fourth ply 30 preferably has a marginal tractor drive end portion 31, and perforations 32 in alignment with the perforations 18, 25. On its top surface 34 there preferably is provided a resin coat (CF) 33 in the same area of the capsule coat 27 (e.g. over the entire face 34).

The preferred mailer 10 also includes a fifth ply 40 having a tractor drive end portion 41 and perforations 42 in alignment with the perforations 18, 25, 32. The cut end 43 thereof is in alignment with the free ends 28, 35, and there is an adhesive section 44 (rewettable glue) adjacent the cut end 43. The ply 40 is of a two sheet construction, a bottom sheet 46 and a top sheet 47 which together form a return envelope, with adhesive 44 on a strip adapted to fold back over the envelope top sheet 47 and seal it. The bottom sheet 46 is slit or perfed to form cut end 43, and extends past end 43 to form a tractor feed section 45.

A third, bottom, ply 50 is also provided having tractor feed ends 51, 52. The third ply 50 cooperates with the top ply 11 to define an outgoing envelope. The second, fourth, and fifth plies 20, 30, and 40 overlie the third ply 50. Note that adhesive is placed along sections 53 (see FIG. 3) of the third ply 50 to attach the top ply 11 to the bottom ply 50 to define the outgoing envelope, and adhesive 54 also is provided inside the marginal edge portions 13, 45, 52 thereof.

While a five ply construction is illustrated for the mailer 10 in FIGS. 1 through 3, a wide variety of other constructions may also be provided. For example a three ply construction may be provided as illustrated by reference numeral 110 in FIG. 4. The FIG. 4 embodiment structures comparable in function to those in the FIGS. 1 through 3 embodiment are shown by the same reference numeral only preceded by a "1".

Figure 4:
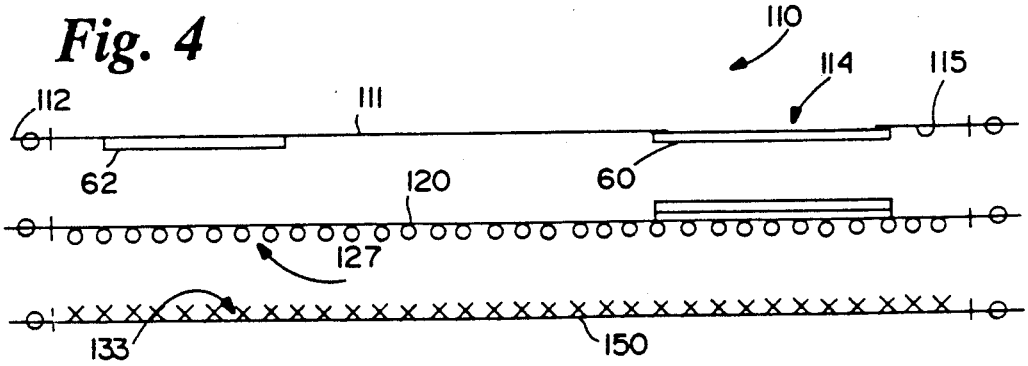
FIG. 4 is a side schematic of a second embodiment of a mailer type business form according to the invention.

In the FIG. 4 embodiment, the third ply 150 is directly in contact with the second ply 120, there being no intervening plies. Also in this embodiment a transparent window patch 60 is applied to cover the cutout 114. This is preferably accomplished by providing a rectangular transparent patch 60 having dimensions greater than the dimensions of the cutout 114 and adhesively secured to the bottom face 115 of the top ply 111. The transparent patch 60 overlies the localized coating of self-imaging material 122, but does not extend a significantly greater distance. In the FIG. 4 embodiment, the top ply 111 also has a carbon spot 62 provided on the bottom surface 115 thereof, which may overlie the capsule and resin coats 127, 133 on the underlying sheets. With the carbon spot 62 at the area of variable printing there is no necessity for a pantograph or blockout printing on the top ply 111.

A wide variety of other constructions can also be provided. Various plies may be of bond, carbonless, carbon interleaf, or other conventional paper types, having other conventional features.

In the typical manner of utilization of the mailer 10 in FIG. 1, which is originally in continuous form (see the connection 55 between two adjacent mailers 10 in FIG. 2), it is fed to an impact printer where variable information is applied. Of course preprinted information may be provided on all of the plies where desired.

The variable address information is applied by impacting with a clear ribbon, or a ribbonless printer, at the cutout area 14. The printer stylus impacting the self-imaging material 22 causes the address to appear. Other portions of the mailer may be impacted by a printing stylus too, such as the portions overlying the coatings 27, 33, to impart variable information on the ply 30.

After the variable information is applied, the mailer 10 is detached along perforated line 55 from other mailers 10, and sent out through the mails. When passing through postal equipment, the self-imaging area 22 is not affected by the pressure of the equipment as much as if it were on the top sheet so therefore there is less blurring of the address information, and the address information may be more effectively optically scanned and read by humans. Once delivered to its ultimate designation, the end user detaches the end strip along the perforations 18, 25, etc. and removes the interior contents by grasping thumb notch (63, FIG. 2) in the left hand and right edge with the right hand and "snapping" in an opposite lateral direction. Under most typical situations, one of the insert plies—either one or both of plies 20, 30—will be inserted in the return envelope comprising the fifth ply 40, adhesive 44 will be brought in contact with the top sheet 47, and the return envelope mailed back to the entity whose address is already preprinted thereon.

It will thus be seen that according to the present invention that a simple yet effective flyless mailer is provided which is not significantly adversely affected by post office handling equipment, and is relatively inexpensive to construct. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and products.

What is claimed is:

1. A mailer type business form comprising:

a top ply having a top surface and a bottom surface, and having means defining a cutout therein, said cutout having an area and position comparable to an address area on a piece of mail;

a second, insert, ply underlying said top ply, including said cutout, and having a top surface in contact with the bottom surface of said top ply and a bottom face;

a localized coating of self-imaging material formed on said second ply top surface only in the area thereof overlaid by said cutout;

a third ply cooperating with said top ply to define an outgoing envelope, said second ply overlying said third ply; and a fourth, insert, ply having a top face thereof in contact with said bottom face of said second ply;

said second ply having a capsule coat on the bottom face thereof, and said fourth ply having a resin coat on the top surface thereof aligned with said capsule coat on said second ply bottom face.

2. A form as recited in claim 1 wherein said cutout is completely open, free of any material therein or covering it.

3. A form as recited in claim 2 wherein said cutout has a generally rectangular shape with sides approximately 3 inches and 1 inch long, and wherein said localized self-imaging material area has a generally rectangular shape with sides slightly greater in length than said cutout.

4. A form as recited in claim 3 further comprising a fifth ply disposed between said third ply and said fourth ply, said fifth ply comprising a return envelope.

5. A form as recited in claim 2 wherein said top ply has a pantograph on the top surface thereof, and block-out print on the bottom surface thereof.

6. A form as recited in claim 2 wherein said top ply has a carbon spot formed on the bottom surface thereof.

7. A form as recited in claim 1 further comprising a patch of transparent material covering said cutout.

8. A form as recited in claim 7 wherein said transparent patch is secured by adhesive to the bottom face of said top ply.

9. A form as recited in claim 7 wherein said cutout has a generally rectangular shape with sides approximately 3 inches and 1 inch long, and wherein said localized self-imaging material area has a generally rectangular shape with sides slightly greater in length than said cutout.

10. A form as recited in claim 1 wherein said top ply has a pantograph on the top surface thereof, and block-out print on the bottom surface thereof.

11. A form as recited in claim 1 wherein said top ply has a carbon spot formed on the bottom surface thereof.

12. A form as recited in claim 11 wherein said third ply comprises the bottom sheet of said form.

13. A form as recited in claim 1 wherein said third ply comprises the bottom sheet of said form.

14. A form as recited in claim 1 further comprising a fifth ply disposed between said third ply and said fourth ply, said fifth ply comprising a return envelope.

15. A form as recited in claim 1 wherein said cutout has a generally rectangular shape with sides approximately 3 inches and 1 inch long, and wherein said localized self-imaging material area has a generally rectangular shape with sides slightly greater in length than said cutout.

16. A form as recited in claim 15 wherein said cutout has a generally rectangular shape with sides approximately 3 inches and 1 inch long, and wherein said localized self-imaging material area has a generally rectangular shape with sides slightly greater in length than said cutout.

17. A mailer type business form comprising:

a top ply having a top surface and a bottom surface, and having means defining a cutout therein, said cutout having an area and position comparable to an address area on a piece of mail;

a second, insert, ply underlying said top ply, including said cutout, and having a top surface in contact with the bottom surface of said top ply, and a bottom face;

a localized coating of self-imaging material formed on said second ply top surface only in the area thereof overlaid by said cutout;

a third ply cooperating with said top ply to define an outgoing envelope, said second ply overlying said third ply;

a fourth, insert, ply having a top face thereof in contact with said bottom face of said second ply; and said second ply having a localized capsule coat on the bottom face thereof non-aligned with said localized coating of self-imaging material formed on said second ply top surface, and said fourth ply having a resin coat on the top surface thereof aligned with said capsule coat on said second ply bottom face.

* * * * *